US010161228B2

(12) United States Patent
Adam et al.

(10) Patent No.: US 10,161,228 B2
(45) **Date of Patent: *Dec. 25, 2018**

(54) METHOD FOR MANAGING A MULTI-LATERAL SNAKY WELL

(71) Applicant: King Fahd University of Petroleum and Minerals, Dhahran (SA)

(72) Inventors: Bramasto Cinde Adam, Dhahran (SA); Sami Abdulaziz Alnuaim, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,874

(22) Filed: Apr. 24, 2018

(65) Prior Publication Data

US 2018/0245436 A1 Aug. 30, 2018

Related U.S. Application Data

(63) Continuation of application No. 14/693,341, filed on Apr. 22, 2015, now Pat. No. 10,030,484.

(51) Int. Cl.
*E21B 43/00* (2006.01)

(52) U.S. Cl.
CPC ..... *E21B 43/00* (2013.01)

(58) Field of Classification Search
CPC ..... E21B 43/00
USPC ..... 702/6
See application file for complete search history.

(56) References Cited

U.S. PATENT DOCUMENTS

| | | | | |
|---|---|---|---|---|
| 5,303,582 | A | 4/1994 | Miska | |
| 7,172,020 | B2 | 2/2007 | Tseytlin | |
| 9,593,558 | B2 * | 3/2017 | Sequeira, Jr. | E21B 7/04 |
| 2009/0319241 | A1 | 12/2009 | Samuel | |
| 2012/0101787 | A1 | 4/2012 | Zhou et al. | |
| 2013/0140037 | A1 | 6/2013 | Sequeira, Jr. | |
| 2014/0305640 | A1 | 10/2014 | Wellington | |

(Continued)

OTHER PUBLICATIONS

Inflow performance relationship (IPR) for solution gas-drive reservoirs—analytical considerations, to Ilk; 2007; all pages.

(Continued)

*Primary Examiner* — Fernando Hidalgo
(74) *Attorney, Agent, or Firm* — Oblon, McClelland, Maier & Neustadt, L.L.P.

(57) ABSTRACT

An apparatus and a method of formulating an empirical correlation model that estimates inflow performance relationship (IPR) of a snaky well. The model provisions for determining inclination and azimuth direction of the snaky well. A plurality of grid models is simulated for a predetermined well bottom-hole pressure. The grid models are validated by comparing the response of each grid to the response of a horizontal well. Sensitivity analysis is performed to determine the impact of the snaky well parameters on the IPR of the snaky well. Additionally, regression analysis is performed based on the sensitivity analysis in order to determine Vogel based quadratic coefficient that estimates the IPR of the snaky well. A transformation of the snaky well parameters is performed in order to determine a sum of squared errors, whereafter a linear weighting of the transformed parameters is computed to determine a correlation parameter of the empirical model.

6 Claims, 13 Drawing Sheets

(56) References Cited

U.S. PATENT DOCUMENTS

| | | | |
|---|---|---|---|
| 2015/0066373 | A1 | 3/2015 | Al-Nahdi |
| 2016/0312607 | A1 | 10/2016 | McNealy |

OTHER PUBLICATIONS

Engineering statistics handbook to Nist/Sematech; 2003; all pages.
Inflow performance relationships for soultions gas drive well to Vogel; 1968; all pages.
K. A. Fattah, et al., "New Inflow Performance Relationship for Solution-Gas Drive Oil Reservoirs", Electronic scientific journal "Oil and Gas Business", 2012; No. 5; http://www.ogbus.ru/eng/, pp. 343-366.

* cited by examiner

METHOD FOR MANAGING A MULTI-LATERAL SNAKY WELL

CROSS-REFERENCE TO RELATED APPLICATIONS

The present application is a Continuation of Ser. No. 14/693,341, now allowed, having a filing date of Apr. 22, 2015.

BACKGROUND

Field of Disclosure

Embodiments described herein generally relate to formulating an empirical correlation model for assessing the productivity of wells having a snaky zig-zag shape and a method for improving oil production from a well according to the empirical correlation model.

Description of the Related Art

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Extended reach and extreme long reach horizontal wells have been deployed by oil industries with a goal to maximize the oil recovery as well as to reduce the development cost per barrel, in many upstream development projects such as deep water, deep gas, and tight reservoirs. Several methods exist to estimate well productivity by Inflow Performance Relationship (IPR) correlations. However, a critical drawback of the existing methods is that they assume the extended and long reach horizontal wells are drilled either at ninety degrees or at a certain inclined angle.

In contrast, geo-steering surveys have revealed that the oil wells have a snaky zig-zag shape. The zig-zag shape of the wells is dictated by the geographical topology of the region where the well is drilled, as well as factors such as isolated sand stringers, permeability, and porosity of the region. Furthermore, due to drilling difficulties in certain geographical regions, the well is constrained to have a zig-zag shape. Currently, the impact of having such a snaky zig-zag shape for the extended reach horizontal wells on the IPR of the well is addressed only through expensive reservoir simulation tools and numerical models. Such a technique proves to be cost-inefficient. Furthermore, simulation of the numerical models incurs an unacceptable processing time, which if constrained to be within a certain bound, may result in inaccurate assessment of the IPR of the well.

Additionally, determining the performance of snaky oil wells has proven to be challenging due to the lack of unanimity in defining the snaky well parameters. For instance, Han. G et al. describe in their work "Study on Undulating Well in Anisotropic Reservoir in Semi-Analytical Method", SPE 167319, prepared at SPE Kuwait Oil and Gas Show, 7-10 Oct. 2013, Kuwait, and incorporated herein by reference in its entirety, that the snaky well can be characterized by an undulation amplitude parameter. R. Kamkom et al., describe in their work "Predicting Undulating Well Performance", SPE 109761, prepared at SPE annual Technical Conference and Exhibition, 11-14 Nov. 2007, California USA, and incorporated herein by reference in its entirety, that the snaky well can be characterized by the number of cycles.

A drawback of the above stated works is that they use semi-analytical models and analytical line source models to develop the productivity performance of snaky horizontal well. Such approaches are time-inefficient and thus cannot be easily implemented as a quick look-up tool to determine the performance of snaky wells. Furthermore, in the works of Cheng. M. in "IPR for solution Gas drive Slanted/Horizontal Wells", SPE 20720, presented at SPE Annual Technical Conference and Exhibition, 23-26 Sep. 1990, New Orleans USA, and incorporated herein by reference in its entirety, and Wiggins. M. et al., in "A Two Phase IPR for horizontal Wells", SPE 94302, presented at 2005 SPE Production and Operation Symposium, 17-19 Apr. 2005, Oklahoma USA, and incorporated by reference herein in its entirety, the developed inflow performance models focused only on inclined horizontal wells (as opposed to snaky wells) for saturated reservoirs.

Accordingly, there is a requirement to develop an empirical correlation technique that can be used to assess the impact of the snaky zig-zag shape of the well on the well's productivity (i.e., IPR of the well). Furthermore, the empirical correlation technique serves as a quick look-up tool to assess the well's productivity in a time-feasible fashion.

SUMMARY

The present disclosure describes a method of developing an empirical correlation model to determine the inflow performance relationship of snaky horizontal wells. According to one embodiment, the empirical model can be employed as a look-up tool to determine the effect the snaky zig-zag shape of the well has on the inflow performance of the well. The formulated correlation model is based on Vogel's empirical inflow performance model and accounts for well geometries, reservoir permeability anisotropy, and oil saturated reservoir.

According to one embodiment, for developing the correlation model, detailed near wellbore modeling is performed in order to mimic the effect of bottom-hole pressure at certain depths in the well and inside the length of a lateral tubing of the well. The near wellbore model is validated with pressure response that is obtained from a typical horizontal well test in order to get good estimates of grid selection that match the bottom hole pressure behavior. The empirical correlation model determines an inflow performance equation of snaky horizontal well in oil saturated reservoir system with a certain range of significance. The correlation model that determines the IPR of snaky horizontal wells is further compared to the existing horizontal well empirical IPR models. According to one embodiment, a close match is obtained between the generated data of snaky horizontal well from reservoir simulations and Wiggin's empirical IPR to the IPR correlation model of snaky horizontal well.

Accordingly an embodiment of the present disclosure provides a method of operating a computer system to formulate an empirical correlation that estimates inflow performance relationship (IPR) of a snaky well. The method includes: modeling inclination and azimuth direction of the snaky well, determining a grid model from a plurality of grid models for the snaky well, simulating a plurality of well geometries for the determined grid model, performing sensitivity analysis to determine impact of a plurality of snaky well parameters on the IPR of the snaky well, performing regression analysis based on the sensitivity analysis to determine Vogel based quadratic coefficient that estimates the IPR of the snaky well, computing by circuitry, a transformation of the plurality of snaky well parameters and determining a sum of squared errors of the plurality of snaky well parameters, and computing by circuitry, a correlation parameter of the empirical model based on a linear weighting of the transformed parameters.

According to one embodiment of the disclosure is provided a non-transitory computer readable medium having stored thereon a program that when executed by a computer causes the computer to execute a method for formulating an empirical correlation that estimates inflow performance relationship (IPR) of a snaky well. The method includes: modeling inclination and azimuth direction of the snaky well, determining a grid model from a plurality of grid models for the snaky well, simulating a plurality of well geometries for the determined grid model, performing sensitivity analysis to determine impact of a plurality of snaky well parameters on the IPR of the snaky well, performing regression analysis based on the sensitivity analysis to determine Vogel based quadratic coefficient that estimates the IPR of the snaky well, computing a transformation of the plurality of snaky well parameters and determining a sum of squared errors of the plurality of snaky well parameters, and computing a correlation parameter of the empirical model based on a linear weighting of the transformed parameters.

According to one embodiment of the disclosure a computing device including circuitry that is configured to: model inclination and azimuth direction of the snaky well, determine a grid model from a plurality of grid models for the snaky well, simulate a plurality of well geometries for the determined grid model, perform sensitivity analysis to determine impact of a plurality of snaky well parameters on the IPR of the snaky well, perform regression analysis based on the sensitivity analysis to determine Vogel based quadratic coefficient that estimates the IPR of the snaky well, compute a transformation of the plurality of snaky well parameters and determining a sum of squared errors of the plurality of snaky well parameters, and compute a correlation parameter of the empirical model based on a linear weighting of the transformed parameters is provided.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

A snaky horizontal well is a horizontal well having a wavy or undulating horizontal portion. Snaky horizontal wells are used in geographical regions having a complex geological terrain which include elongated faults, reservoirs that are isolated by shales, disconnected sand stringers, multilayered reservoirs, or the like. As described by Bacarreza L. et al. in "The Snaking Wells in Champion West, Offshore Brunei. Best Practices for ERD Well Construction", IADC/SPE 114550, prepared at the IADC/SPE Asia Pacific Drilling Technology Conference and Exhibition, 25-27 Aug. 2008, Jakarta, Indonesia, and incorporated by reference herein in its entirety, snaky horizontal wells have been proven to be successful in the Brunei Shell Petroleum project. Snaky wells typically traverse across multiple layers of the earth and have a dipping reservoir geometry that results in multiple drainage voids for each reservoir zone, thereby maximizing the productivity of the well.

Figure 1:
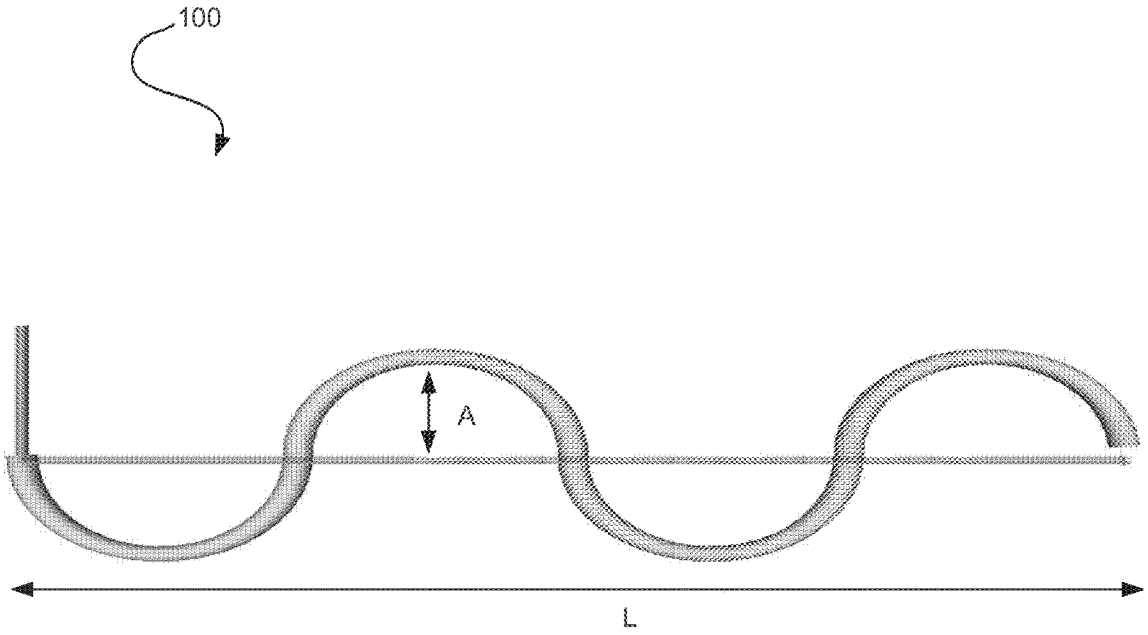
FIG. 1 illustrates an exemplary schematic of a snaky well.

FIG. 1 depicts an exemplary snaky well 100. The snaky well 100 is characterized by a height of undulation parameter represented by 'A', and a horizontal span parameter denoted by 'L'. According to one embodiment, the snaky well 100 is characterized by an undulation amplitude parameter $\lambda$, which is defined herein as a ratio of the height of undulation parameter to the horizontal span parameter of the snaky well (i.e., $\lambda=A/L$).

Figure 2:
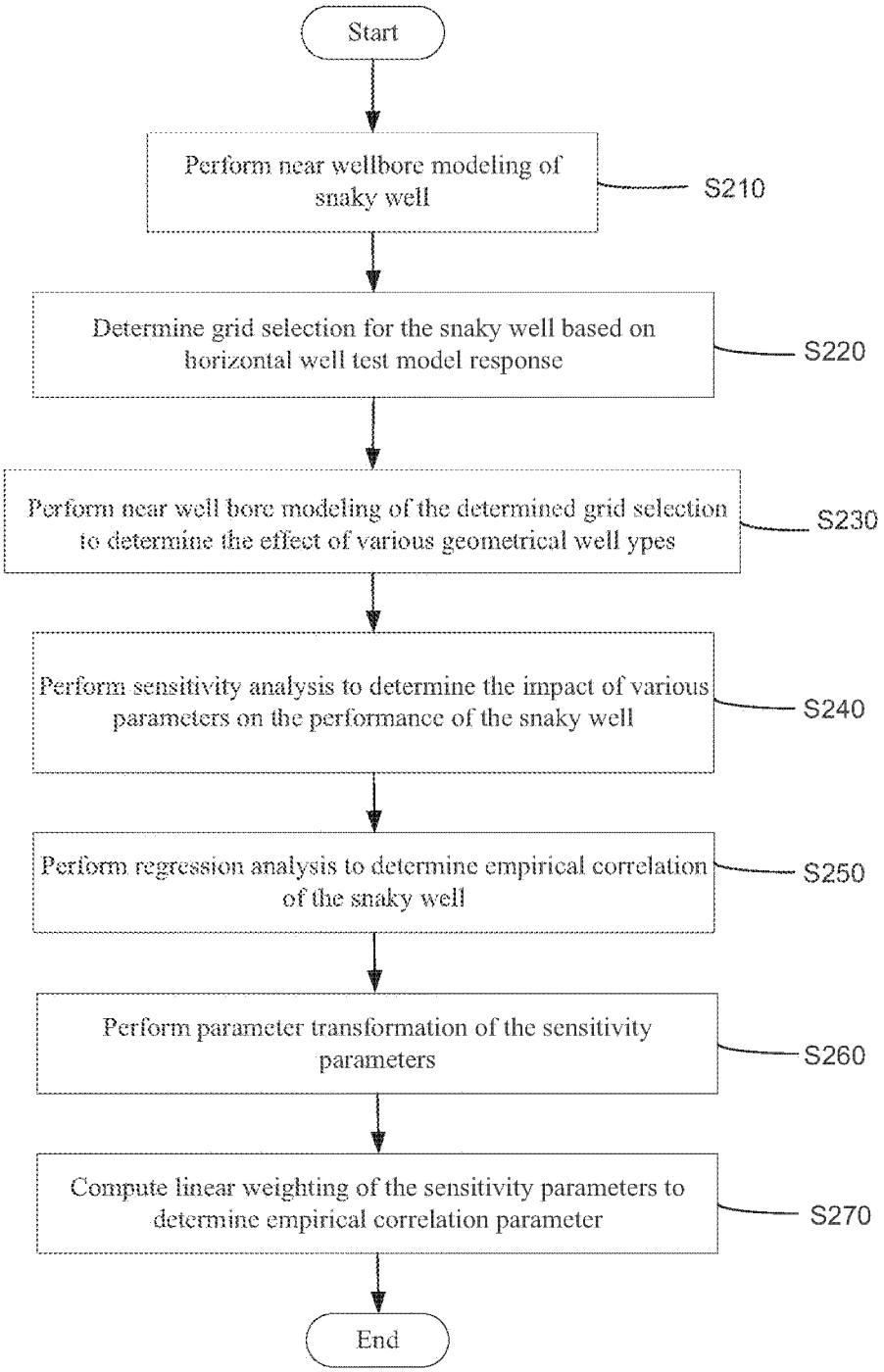
FIG. 2 depicts a flowchart illustrating the steps performed to determine inflow performance relationship of snaky wells.

FIG. 2 depicts a flowchart illustrating the steps performed in order to determine the inflow performance relationship (IPR), i.e., productivity of snaky horizontal wells. The method to estimate the productivity of snaky oil horizontal wells as depicted in FIG. 2 ensures that the reservoir simulation model encompasses complexities of the well geometry and reservoir flow conditions. Further, typical response of pressures in horizontal oil well tests are used to validate the well's bottom-hole pressure behavior. Upon the model resembling the prediction of the pressure behavior, sensitivity analysis of impacting parameters is conducted, whereafter the results are brought to a generalized Vogel based model as described by J. Vogel in "Inflow Performance Relationships for Solution-Gas Drive Wells", SPE 1476, presented at SPE 41st Annual Fall Meeting, Oct. 2-5, 1966, Texas USA, and incorporated herein by reference in its entirety, by performing quadratic regression analysis. Additionally, according to one embodiment, a statistical approach is used to determine the significant parameter that produces the least summation error. According to one embodiment, linear weighting of the significant parameter(s) is performed in order to finalize the inflow performance correlation equation.

The method of FIG. 2 formulates an empirical correlation for the snaky well that can be used to assess the impact of a plurality of parameters on the productivity of the well as a quick look-up tool. In step S210, near well modeling is performed to build the details of the snaky horizontal well. The near wellbore modelling provisions for determining the geometry and trajectory design of the well. According to one embodiment, near wellbore modeling (NWM) sub-option from a commercial reservoir numerical simulator is used. The simulator provisions for modelling the well behavior from a certain volume of interest (VOI). The VOI defines how long the extension of the well boundary is, whereas the trajectory of the well is designed from a minimum curvature method as described by Inglis T. A in "Petroleum Engineering and Development Studies", Vol. 2 Directional Drilling, Graham & Trotman Limited, London, and incorporated herein in its entirety. The minimum curvature method allows a user to define the inclination and azimuth direction of the well.

According to one embodiment, the snaky horizontal section of the well is divided into an optimal number of segments in order to improve the details of the well model. The computation inside the tubing is performed based on the wellbore fluids hydraulic, friction and acceleration (HFA) components, with a drift flow model along the well segmentations. The drift-flux technique as described by Edwards D. et al. in "Near wellbore modeling method and apparatus", Patents WO1999057418A1. 1999, and incorporated by reference herein in its entirety, is well-suited for modeling multiphase wellbore flow in reservoir simulators as the calculation of phase velocities is simple and efficient and the equations are continuous and differentiable as required by the simulator. In the drift flux option, the flow model allows slip velocity between phases (not homogenous), flow phases in opposite directions in case of low rates and better accuracy in pressure gradient calculation from segment to segment throughout the well. It must be appreciated that the computations are performed in an implicit fashion wherein, the computation for each segment is performed by using local flowing conditions.

Upon performing the near wellbore modelling of the snaky well in step S210 of FIG. 2, the process proceeds to step S220. In step S220, local grid refinement (LGR) is performed for the snaky well. LGR is a technique of defining fine grid cells of small size in some regions of the overall modeled volume with coarse grid cells of larger size defining other regions of the volume. Transmission corrections derived from the fine grid cells can be applied to the coarse grid cells to accurately simulate production of the reservoir. In order to ensure that the response of the snaky well model is accurate, test results from a horizontal well test model are used. Specifically, a drawdown test (i.e., a specific test rate and a corresponding bottom-hole pressure profile due the rate) is conducted at certain datum points against different grid selections. According to an embodiment, grids that are evaluated include structured Local Grid Refinement (LGR) grid, unstructured LGR grid and no-LGR grid.

Figure 3:
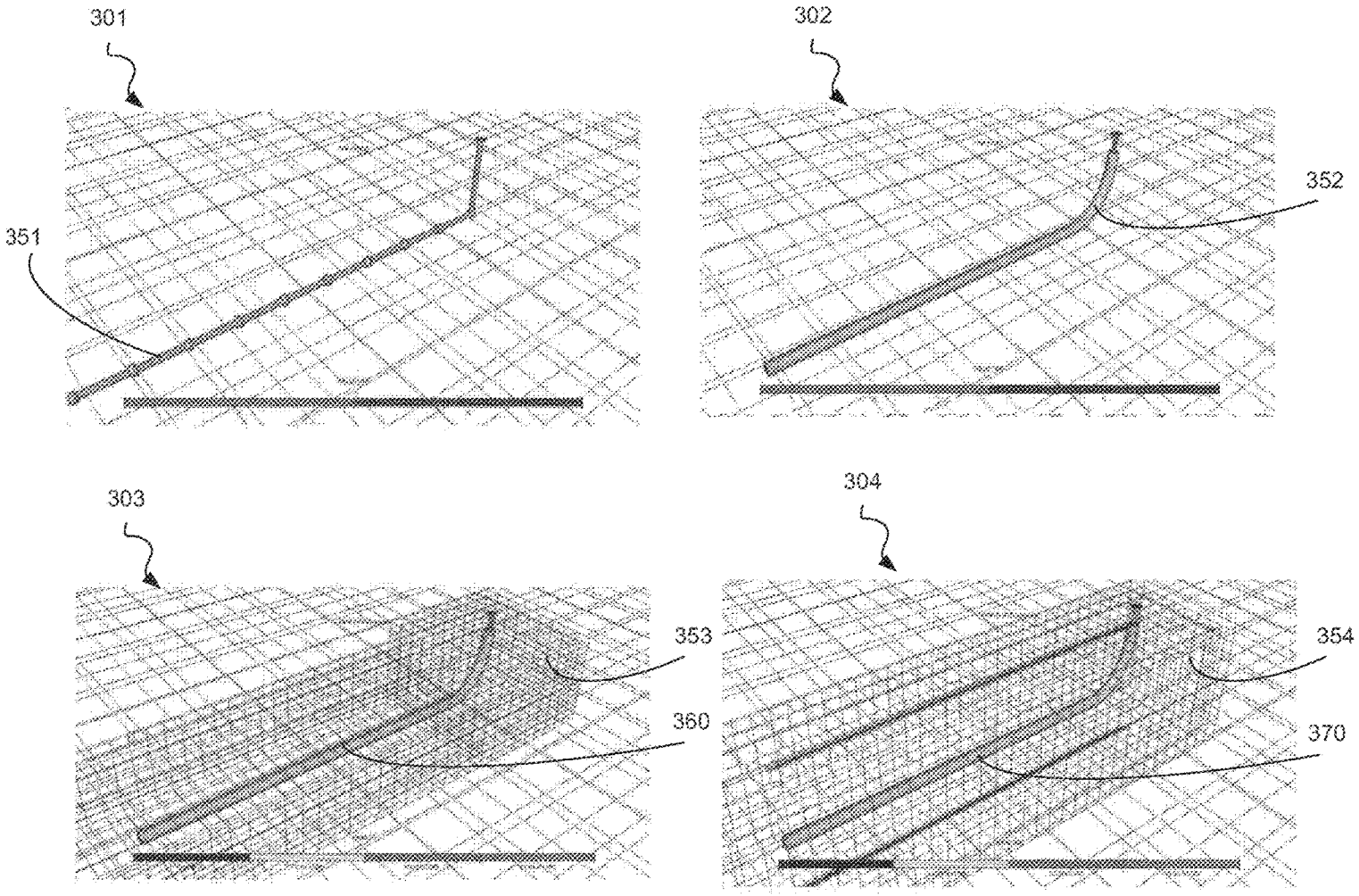
FIG. 3 illustrates exemplary schematic of grid models.
Figure 4:
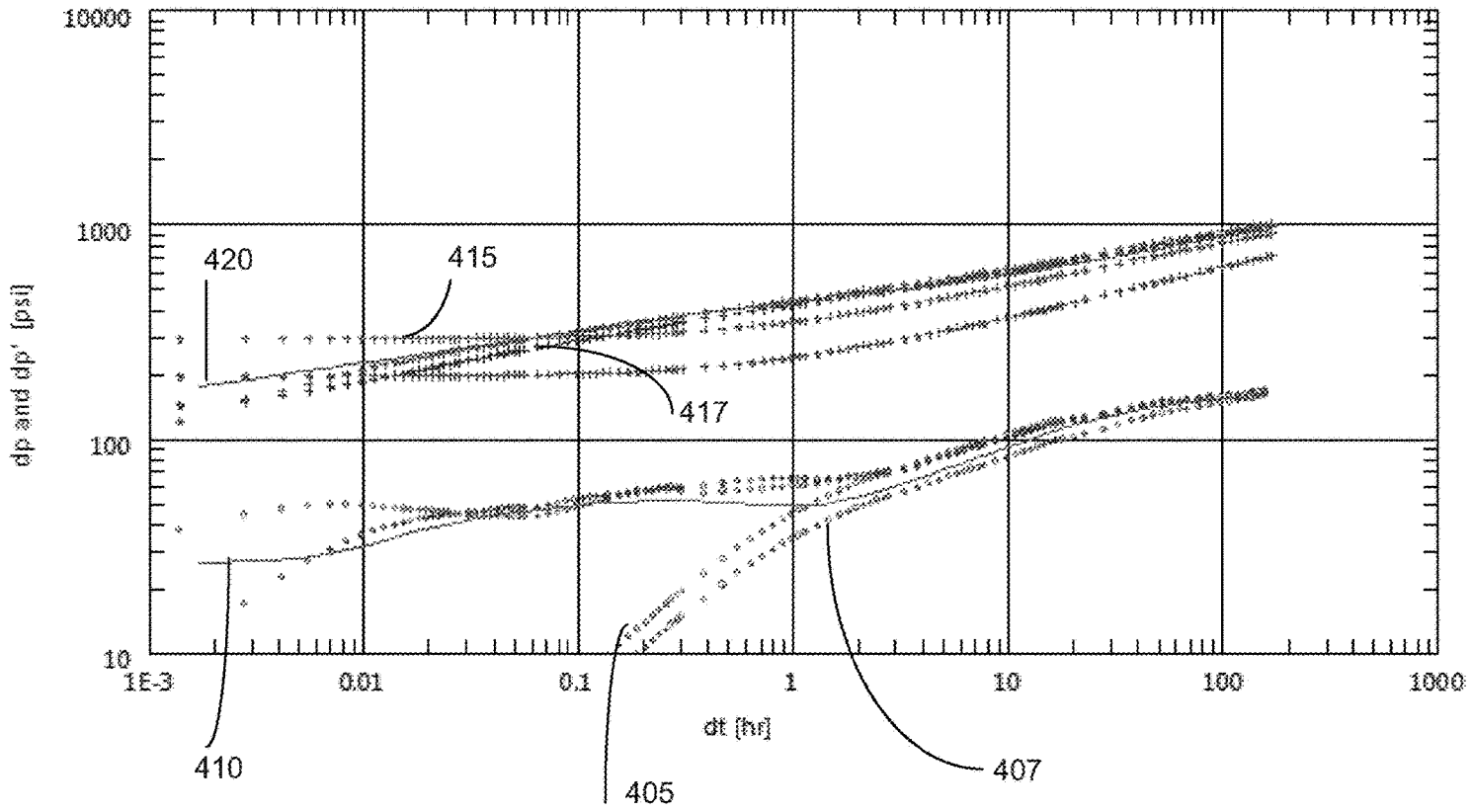
FIG. 4 is a graph depicting response of a drawdown test for different grid models.

FIG. 3 illustrates exemplary grid models according to one embodiment. The grid model 301 includes a horizontal well 351 without trajectory, whereas the grid model 302 includes a horizontal well 352 with trajectory design. The grid model 303 includes a horizontal well 360 with trajectory design and a structured LGR 353, whereas the grid model 304 includes a horizontal well 370 with trajectory design and unstructured LGR 354. Simulation results for the drawdown test response of the grid models of FIG. 3 are depicted in FIG. 4. The pressure derivative response of the drawdown test clearly shows certain discrepancies in the type of grid selection being made. For instance, referring to FIG. 4, optimum structured LGR (curve 415) and unstructured LGR (curve 417) give close result to a true response (curve 420). Additionally, the performance of a horizontal well without trajectory design is denoted by curve 407 and the response of a horizontal well with trajectory design is represented by curve 405. Both curves 405 and 407 are close to the true response of a horizontal well with no LGR (curve 410). It must be appreciated that the true response is obtained by computing the analytical solution of diffusivity equations (reservoir flow) in a typical horizontal well model.

According to an embodiment, the simulation results of the optimum LGRs mimic the analytical design. However, optimum structured LGR grid system is selected in further well model developments due to the simplicity in its modelling. Furthermore, according to one embodiment, the optimum grid dimension of LGR structured system in each grid cells are 5 feet in height and 20 feet in length. Table I depicts the generated data of the drawdown test in the horizontal well for validation of grid models, wherein the parameter k corresponds to permeability of the well and the parameters x, y, z denote the directions in the X-axis, Y-axis, and Z-axis, respectively. The parameter L corresponds to the length of the horizontal well, the parameter rw corresponds to the well bore radius, and the parameter h corresponds to the thickness of the reservoir.

TABLE I

Validation data for horizontal well test.

| | | | | | |
|---|---|---|---|---|---|
| kx | 100 | mD | porosity | 0.2 | |
| ky | 100 | mD | oil viscosity | 2 | cp |
| kv/kh | 0.1 | | Bo | 1.2 | bbl/stb |
| L | 2000 | ft | h | 100 | ft |
| rw | 0.25 | ft | | | |

Figure 5:
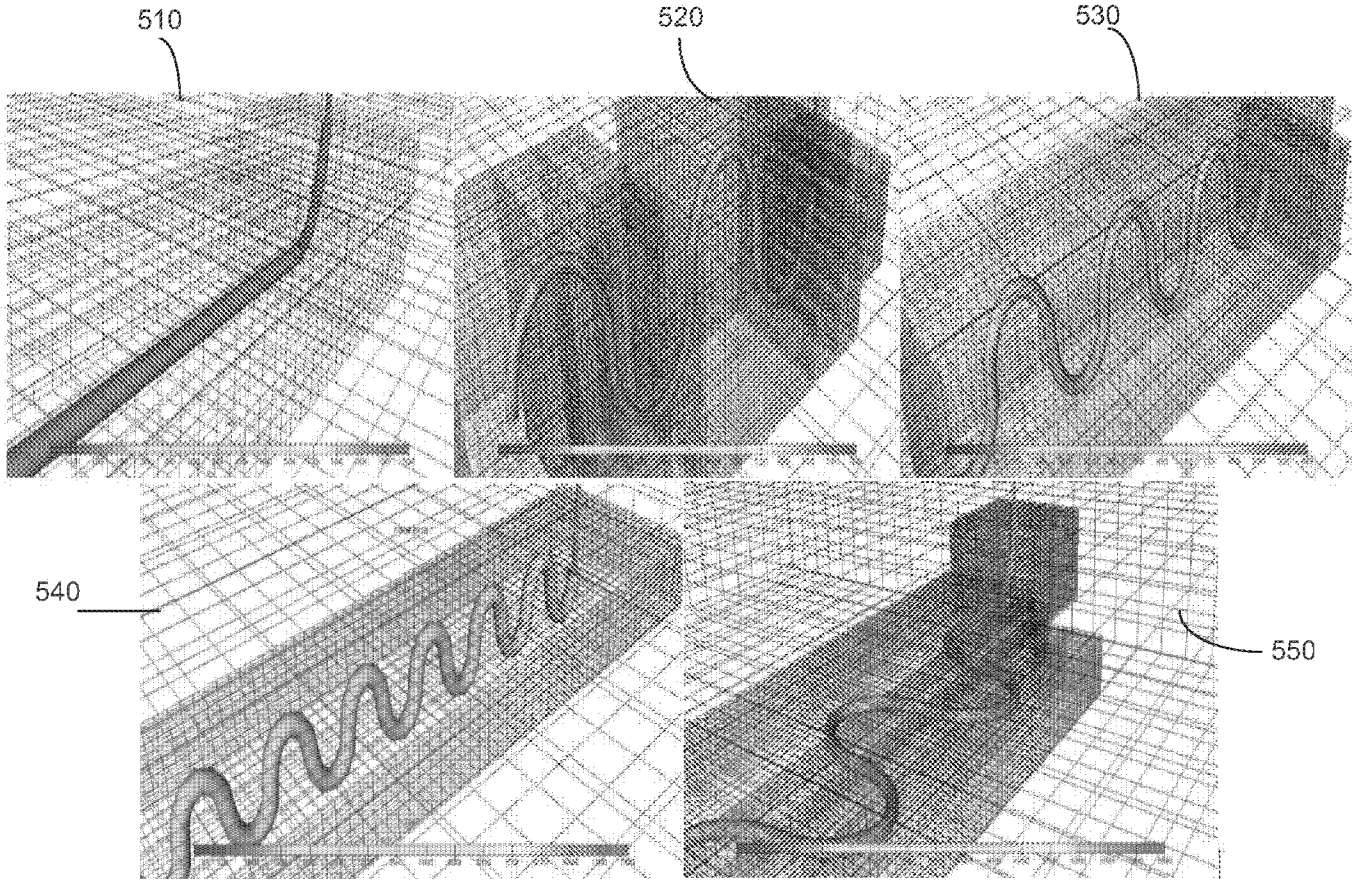
FIG. 5 illustrates geometry of different snaky wells.

Upon determining the type of grid model to be employed (step S220), near wellbore modelling of the determined grid model is performed in step S230, in order to determine the effect of various geometrical well types, heterogeneity of reservoir properties and fluid properties. Note that heterogeneity of reservoir properties includes the effect of horizontal and vertical permeability anisotropy of the well, whereas the reservoir fluid corresponds to saturated reservoir systems with low, medium and high gas-to-oil ratio (GOR). The geometrical snaky horizontal well models are selected based on buildup rate criteria and the direction of well trajectory design. According to one embodiment, different well geometries for the snaky well are evaluated. FIG. 5 depicts different well geometries such as a horizontal well 510, and snaky wells having different number of undulations as depicted in 520, 530 and 540. Furthermore snaky wells that have a vertical orientation (520, 530 and 540) and a horizontal orientation (550) are also evaluated.

The process then proceeds to step S240 wherein sensitivity analysis is performed in order to determine the impact of various parameters on the performance of the snaky well. Sensitivity analysis is defined as a study of how the uncertainty in the output of a mathematical model or system (numerical or otherwise) can be apportioned to different sources of uncertainty in its inputs. Specifically, each simulation scenario is executed for a predetermined well flowing bottom hole pressure (pwf), to get the response of how much oil rate is occurred. According to one embodiment, the grid dimensions of the model are 40×30×5 grids with the length of each grid being 100 ft. Structured LGR system is constructed along the vicinity of the snaky horizontal well section with detail size of 5 ft in height. The top reservoir is at 6500 ft depth with initial pressure of approximately 3000 psi. Furthermore, the residual oil and connate water saturation are 0.2 and 0.25 respectively, as for water wet system. The water production is zero and all the simulations provision for two phases of oil and gas.

Further, in step S250 regression analysis is performed in order to determine an empirical correlation for the snaky well. Regression analysis is an approach to model the relationship between scalar dependent variables and one or more explanatory (i.e., independent) variables. According to one embodiment, each simulation scenario is constrained with flowing bottom-hole pressure in order to obtain a possible rate that occurs on a daily average. Then, flowing bottom-hole pressure constraints are simulated to construct productivity/inflow performance of certain reservoir/fluid/well conditions. From the results of bottom-hole pressure and oil rates, the Inflow Performance Relationship is constructed using dimensionless normalized pressure (Pwf/Pr) and rate (Qo/Qo max) in a Vogel based form. According to one embodiment, the empirical snaky horizontal Inflow Performance Relationship (IPR) is generated in dimensionless form (Pwf/Pr versus Qo/Qo max), and has a Vogel like format. The empirical correlation computed via regression analysis has a quadratic equation form as:

$$\frac{q}{q_{max}} = 1 - f_1 \frac{P_{wf}}{P_r} - (1 - f_1)\left(\frac{P_{wf}}{P_r}\right)^2 \tag{1}$$

wherein, $P_r$ is average reservoir pressure, $P_{wf}$ is the bottom hole pressure, q is the oil rate, $q_{max}$ is the maximum oil rate/AOF, and $f_1$ is the generalized Vogel based quadratic parameter. The parameter $f_1$ corresponds to the characteristic of certain parameter conditions or quadratic component in Vogel dimensionless equation form. According to an embodiment, the parameter $f_1$ is approximated from the regression analysis of each sensitivity parameters.

According to one embodiment, the effect of certain parameter is transformed to get the lowest sum of squared error (SSE) as shown in step S260 of the flowchart in FIG. 2. The total error is derived from the square of the difference between generated data to best fit correlation of specific parameter sensitivity/condition. $f_1$ is a function in which all the parameters have linear terms. According to one embodiment, the Box Cox method as described by Montgomery. D, in "Design and Analysis of Experiments", Wiley, New York, and incorporated by reference herein in its entirety is used to transform the sensitivity parameters. For instance, by using the Box-Cox method, $f_1$ is transferred to $f_1^{\gamma}$, where $\gamma$ is a constant. Further, by performing statistical analysis in determining the SSE from different $\gamma$ values, one can obtain the value of $\gamma$ that yields the best equation form.

In other words, the Box-Cox method provisions for the transformation of sensitivity parameters that affect IPR of snaky horizontal well into quadratic constant ($f_1$) in Vogel equation, i.e., the Box-Cox method provides a mechanism to obtain a close approximation of the quadratic constant $f_1$. According to one embodiment, the Box-Cox method evaluates each parameter during simulation in order to get an IPR curve (dimensionless P and Q) and then performs quadratic curve fitting by quadratic regression analysis. At this instant, a value of $f_1$ for the specific parameter (under consideration) and the difference between generated IPR points and fitted curve are obtained.

Further, the differences are squared and summed (SSE) and plotted with a parameter transform in order to obtain parameter transforms that have less error. Specifically, parameter transform ($\gamma$) into ($f_1^{\gamma}$) implies the training of specific quadratic constant ($f_1$) with power transform, for example $f_1^{0.5}$, $f_1^{1}$, $f_1^{3}$ etc. Upon completing the procedure for all specific parameters, the form of ($f_1$) is approximated with linear summation/combination of each specific parameter that has been transformed and has low error. Thus, the specific form of ($f_1$) will also have the summation of error of each specific parameter. Note that at this time instant, a specific value of $f_1$ is obtained for a specific condition of parameters i.e., a specific scenario. Further, the above steps are repeated for other sensitivity/scenario of common values of parameters. Thus, from these sensitivity scenarios, one can obtain specific values of ($f_1$) corresponding to specific conditions.

Upon completing the parameter transformation by the Box-Cox method in step S260, a linear weighing of the sensitivity parameters is performed in step S270 in order to obtain a final form of $f_1$. In order to achieve this, the constant of each parameter or linear weighting constant ($\omega$) is treated as constant to get close results that satisfy all scenarios. The matrix of the weighing constants can be derived by multiplying the pseudo inverse of matrix ($f_1$) to matrix of parameters as described below.

A matrix of parameters for each scenario with constant weightings is used to get the final form of $f_1$. The matrix equation can be expressed below:

$$\begin{aligned}
&\omega_1 C_{11} + \omega_2 C_{21} + \omega_3 C_{31} + \omega_4 C_{41} + \omega_5 C_{51} = B_1 \\
&\omega_1 C_{12} + \omega_2 C_{22} + \omega_3 C_{32} + \omega_4 C_{42} + \omega_5 C_{52} = B_2 \\
&\omega_1 C_{13} + \omega_2 C_{23} + \omega_3 C_{33} + \omega_4 C_{43} + \omega_5 C_{53} = B_3 \\
&\cdots \\
&\omega_1 C_{1n} + \omega_2 C_{2n} + \omega_3 C_{3n} + \omega_4 C_{4n} + \omega_5 C_{5n} = B_n
\end{aligned} \tag{2}$$

The matrix (2) for the case of parameters horizontal distance, height of undulation, GOR, vertical permeability ratio and horizontal permeability ratio can be expressed as:

$$\begin{aligned}
&\omega_1\left(\frac{kx}{ky}\right)_1 + \omega_2\left(\frac{kv}{kh}\right)_1 + \omega_3\left(\frac{1}{A}\right)_1 + \omega_4(L)_1 + \omega_5\left(\frac{1}{GOR}\right)_1 = (f_1)_1 \\
&\omega_1\left(\frac{kx}{ky}\right)_2 + \omega_2\left(\frac{kv}{kh}\right)_2 + \omega_3\left(\frac{1}{A}\right)_2 + \omega_4(L)_2 + \omega_5\left(\frac{1}{GOR}\right)_2 = (f_1)_2 \\
&\omega_1\left(\frac{kx}{ky}\right)_3 + \omega_2\left(\frac{kv}{kh}\right)_3 + \omega_3\left(\frac{1}{A}\right)_3 + \omega_4(L)_3 + \omega_5\left(\frac{1}{GOR}\right)_3 = (f_1)_3 \\
&\cdots \\
&\omega_1\left(\frac{kx}{ky}\right)_n + \omega_2\left(\frac{kv}{kh}\right)_n + \omega_3\left(\frac{1}{A}\right)_n + \omega_4(L)_n + \omega_5\left(\frac{1}{GOR}\right)_n = (f_1)_n
\end{aligned} \tag{3}$$

Equation (2) can be represented in matrix notation as:

$$\begin{bmatrix} C_{11} & C_{21} & \cdots & C_{51} \\ C_{12} & O & & \\ M & & & \\ C_{1n} & & & C_{5n} \end{bmatrix} \begin{bmatrix} \omega_1 \\ M \\ \omega_5 \end{bmatrix} = \begin{bmatrix} B_1 \\ M \\ B_n \end{bmatrix} \tag{3}$$

wherein, matrix C according to one embodiment, corresponds to the sensitivity parameters such as horizontal distance, height of undulation, GOR, vertical permeability ratio and horizontal permeability ratio. Matrix B is the quadratic expression in Vogel form ($f_1$), whereas subscript n indicates the number of sensitivity scenarios that are simulated. Similarly, equation (3) can be expressed in matrix notation as follows:

$$\begin{bmatrix} \left(\frac{kx}{ky}\right)_1 & \left(\frac{kv}{kh}\right)_1 & \cdots & \left(\frac{1}{GOR}\right)_1 \\ \left(\frac{kx}{ky}\right)_2 & O & & \\ M & & & \\ \left(\frac{kx}{ky}\right)_n & & & \left(\frac{1}{GOR}\right)_n \end{bmatrix} \begin{bmatrix} \omega_1 \\ M \\ \omega_5 \end{bmatrix} = \begin{bmatrix} (f_1)_1 \\ M \\ (f_1)_n \end{bmatrix} \tag{4}$$

The constant of each parameters (ω) can be derived by multiplying the pseudo inverse of matrix C to B, in order to obtain the least squares solution with the smallest norm. According to one embodiment, the result of $f_1$ is obtained as:

$$f_1 = 0.0435\frac{kx}{ky} - 0.0946\frac{kv}{kh} + \frac{3.0455}{A} - 0.0001368L + \frac{232.074}{GOR} \tag{5}$$

wherein, A is the height of undulation of the snaky well, GOR is the solution gas-to-oil ratio, L is the horizontal distance of the well, kx, ky are the permeability in the x and y directions, respectively and kh, kv are the horizontal and vertical permeability along the thickness of the reservoir. Furthermore, the Vogel based inflow performance relationship can be expressed as:

$$\frac{q_o}{q_{o,max}} = 1 - \left[ 0.0435\frac{kx}{ky} - 0.0946\frac{kv}{kh} + \frac{3.0455}{A} - 0.0001368L + \frac{232.074}{GOR} \right] \frac{P_{wf}}{P_r} - \left( 1 - \left[ 0.0435\frac{kx}{ky} - 0.0946\frac{kv}{kh} + \frac{3.0455}{A} - 0.0001368L + \frac{232.074}{GOR} \right] \right) \left( \frac{P_{wf}}{P_r} \right)^2 \tag{6}$$

The sensitivity parameters that affect the performance of the well are illustrated below in the Table II.

TABLE II

| Sensitivity parameters | | | |
|---|---|---|---|
| Kx/Ky | 1 | 2 | 4 |
| Kv/KH | 0.1 | 0.3 | 0.5 |
| GOR (scf/stb) | 332 | 400 | 943 |
| Height of Undulation (ft) | 163.55 | 97.08 | 48.54 |
| Horizontal Distance (ft) | 1307.13 | 1960.69 | 2614.25 |

According to one embodiment, upon modelling and validating the snaky well, simulations are performed to determine the significance of each variable on the performance of the snaky well. FIGS. 6A-6K depicts graphs illustrating the performance of snaky wells.

Figure 6A:
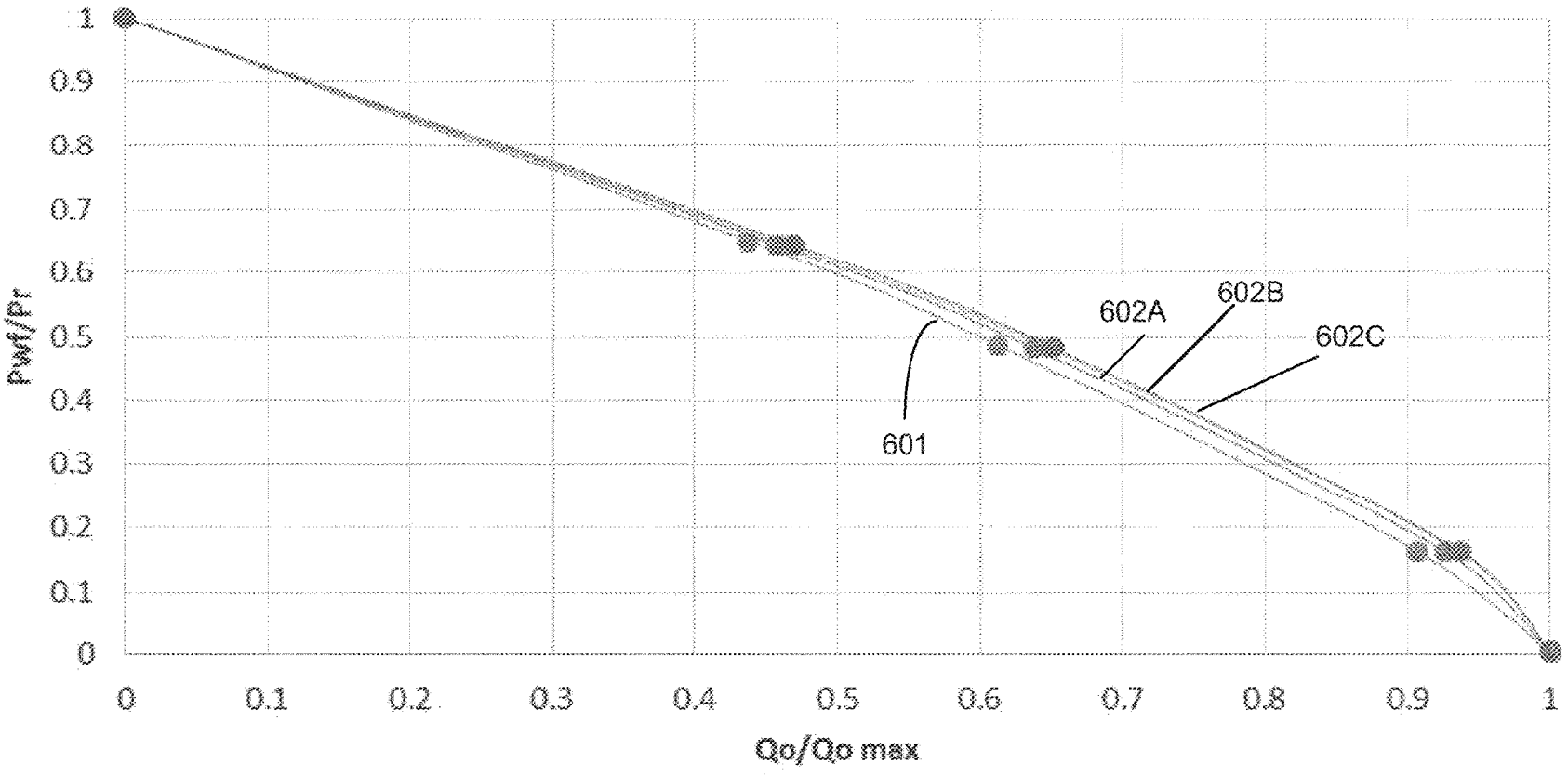
FIGS. 6A-6G depict graphs illustrating the performance of snaky wells.

FIG. 6A depicts a graph illustrating the comparison of IPR of snaky well to the IPR of a flat 90 degree horizontal well. In FIG. 6A, curve 601 depicts the performance of a horizontal 90 degree well, whereas the curves 602A-602C depict the performance of snaky wells having build-up rates (BUR) i.e., rate of increase of inclination's degree per 100 ft of unit depth, of 35°/100 ft, 118°/100 ft, and 59°/100 ft respectively. From FIG. 6A, it can be observed that the curves (depicting the performance of the snaky well) are shifted towards the right, thereby indicating that the flat 90 degree horizontal well under predicts the performance of the snaky horizontal well model. For instance, for the snaky well having a BUR of 35°/100 ft, the curve is shifted 3-6% to the right of the curve corresponding to the horizontal well.

Figure 6B:
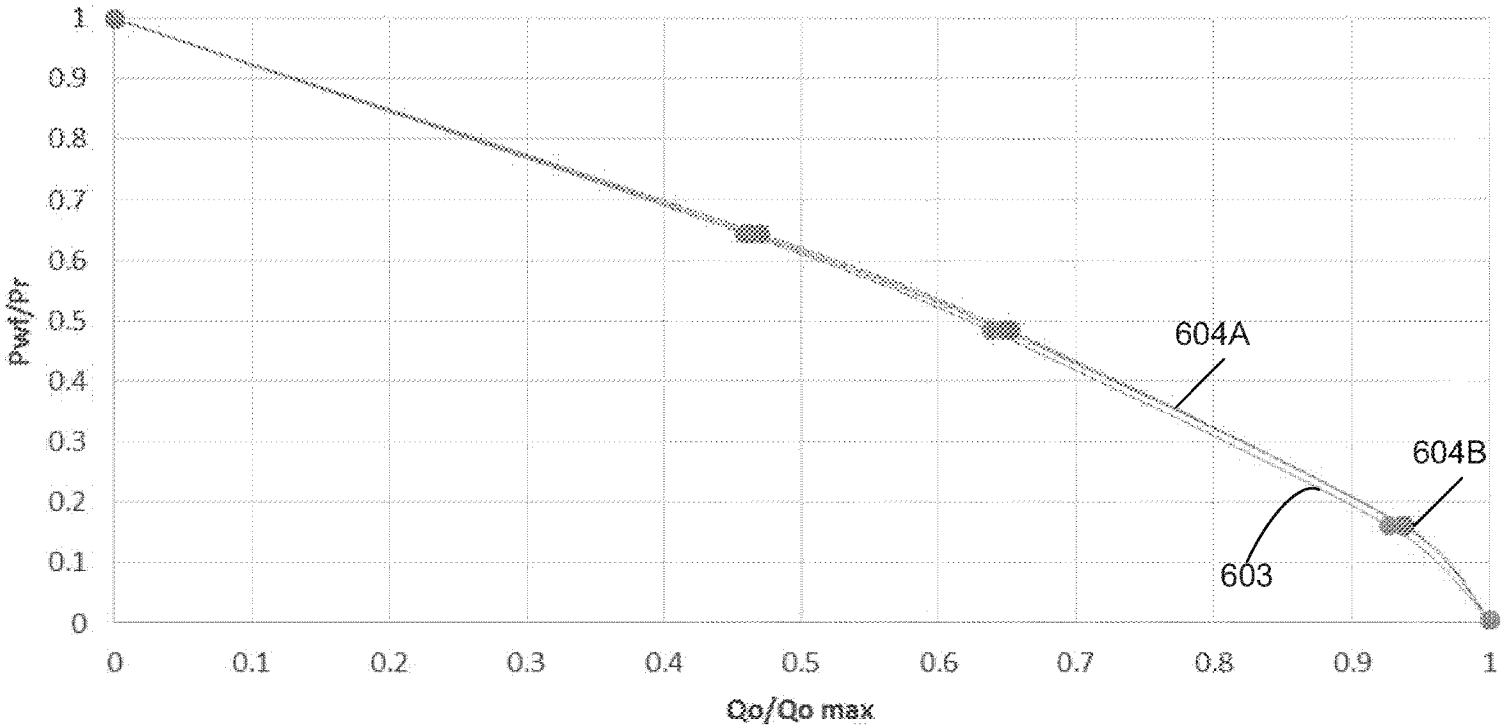

FIG. 6B depicts a graph illustrating the impact of undulation height of the snaky well on the IPR of the well. In FIG. 6B, the curves 603, 604A, and 604B correspond to snaky wells having an undulation height and BUR of (48 feet, 118 BUR), (97 feet, 59 BUR), and (163 feet, 35 BUR), respectively. Note that the height of the undulation indicates the difference of the height of an undulation to a datum depth of zero cycle i.e., height of one bell shape of the well geometry. As shown in FIG. 6B, the well's productivity increases as the undulation height of the well increases, as the area of the reservoir contact increases in order to drain the same reservoir volume.

Figure 6C:
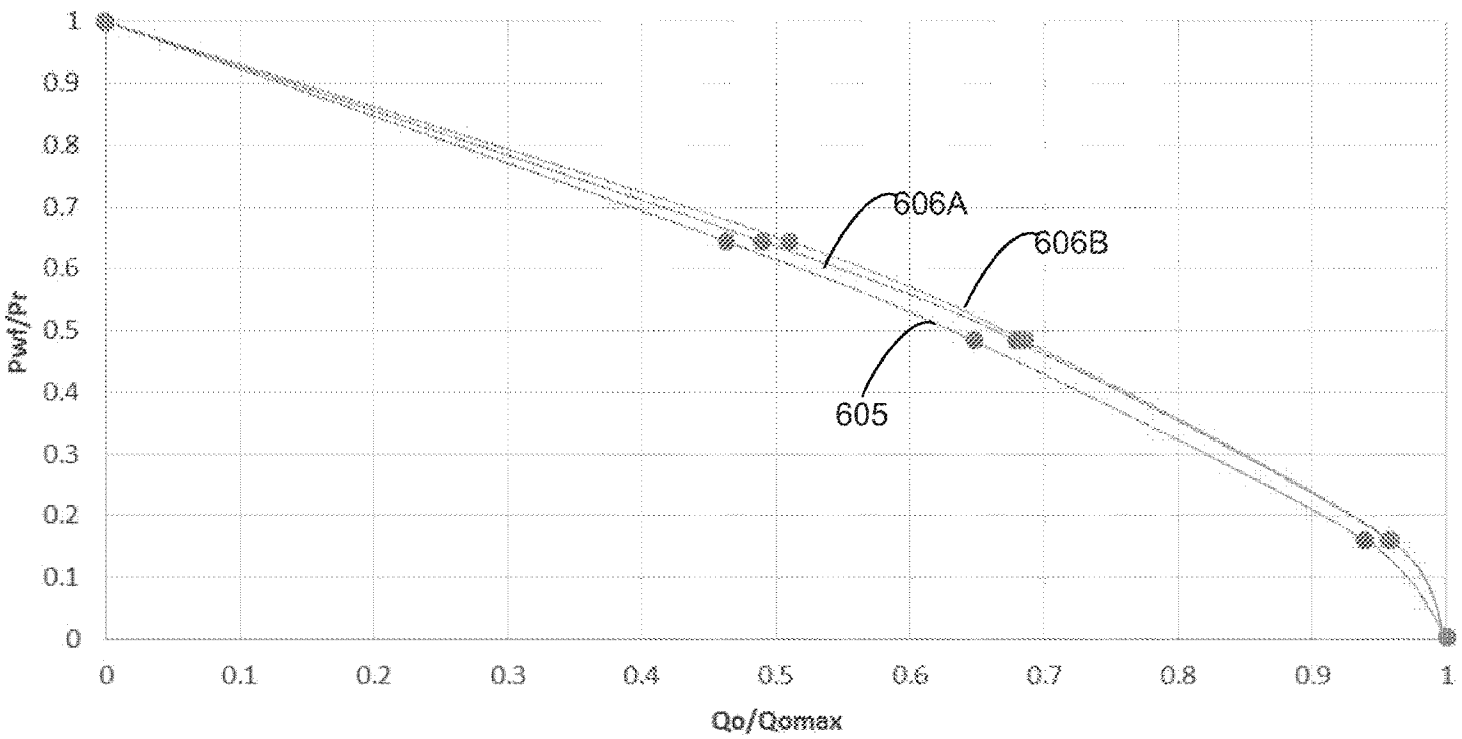

FIG. 6C depicts a graph illustrating the impact of the horizontal distance parameter of the well on the IPR of the snaky well. In FIG. 6C, curves 605, 606A, and 606B correspond to the performance of snaky wells having a horizontal distance of 1307 feet, 1960 feet, and 2614 feet respectively. It can be observed that a greater horizontal distance of the snaky well results in higher production of the well since the production area is larger along the horizontal distance of the well.

Figure 6D:
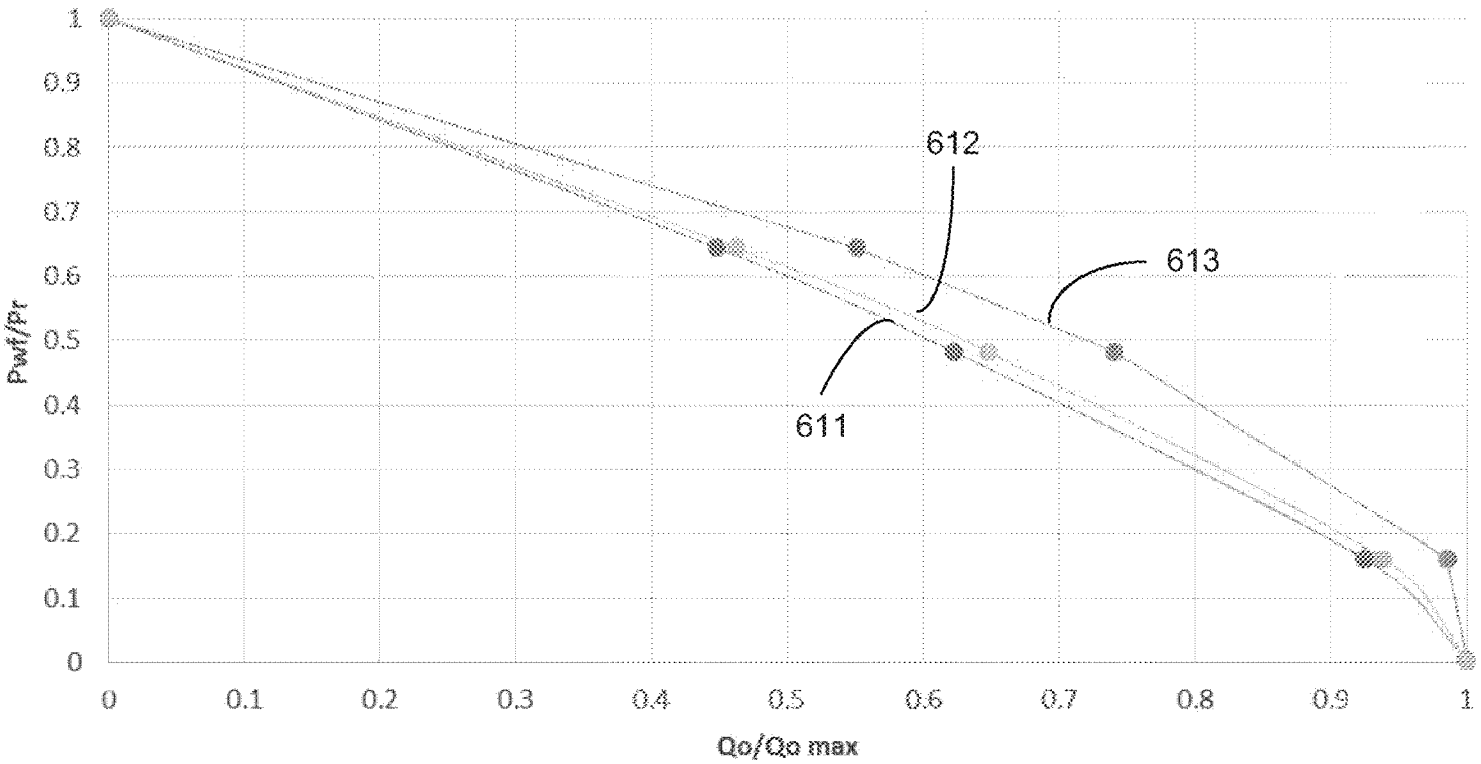

FIG. 6D depicts a graph illustrating the impact of the parameter gas-to-oil ratio (GOR) on the productivity of the snaky well. In FIG. 6D, the curves 611, 612, and 613 correspond to GOR of low, medium, and high respectively. From FIG. 6D, it can be observed that as the solution GOR increases and bubble point pressure is kept constant, the viscosity of fluid reduces due to higher gas content in the solution. Consequently, the fluid flows easily thereby increasing the productivity of the snaky well.

Figure 6E:
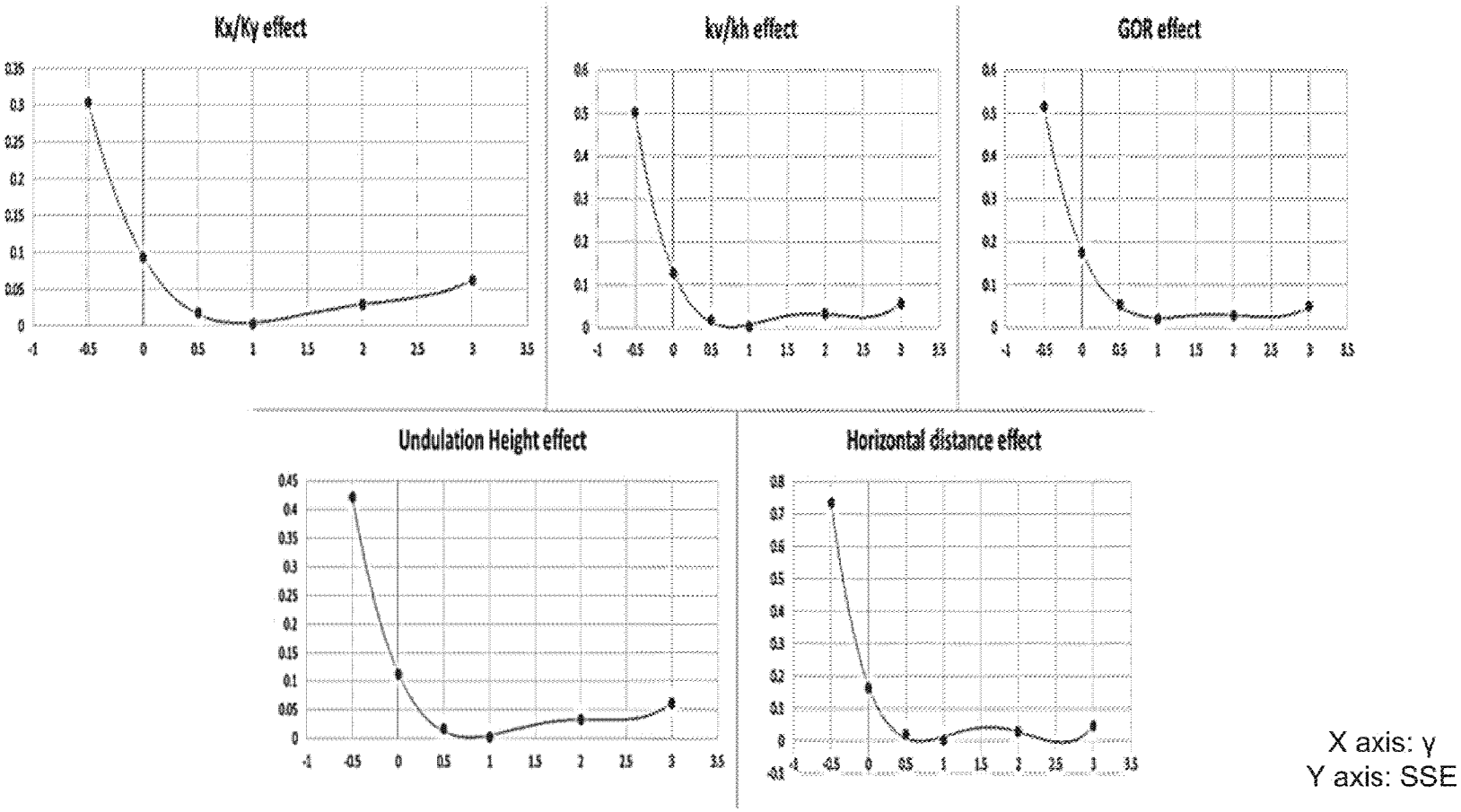
Figure 6F:
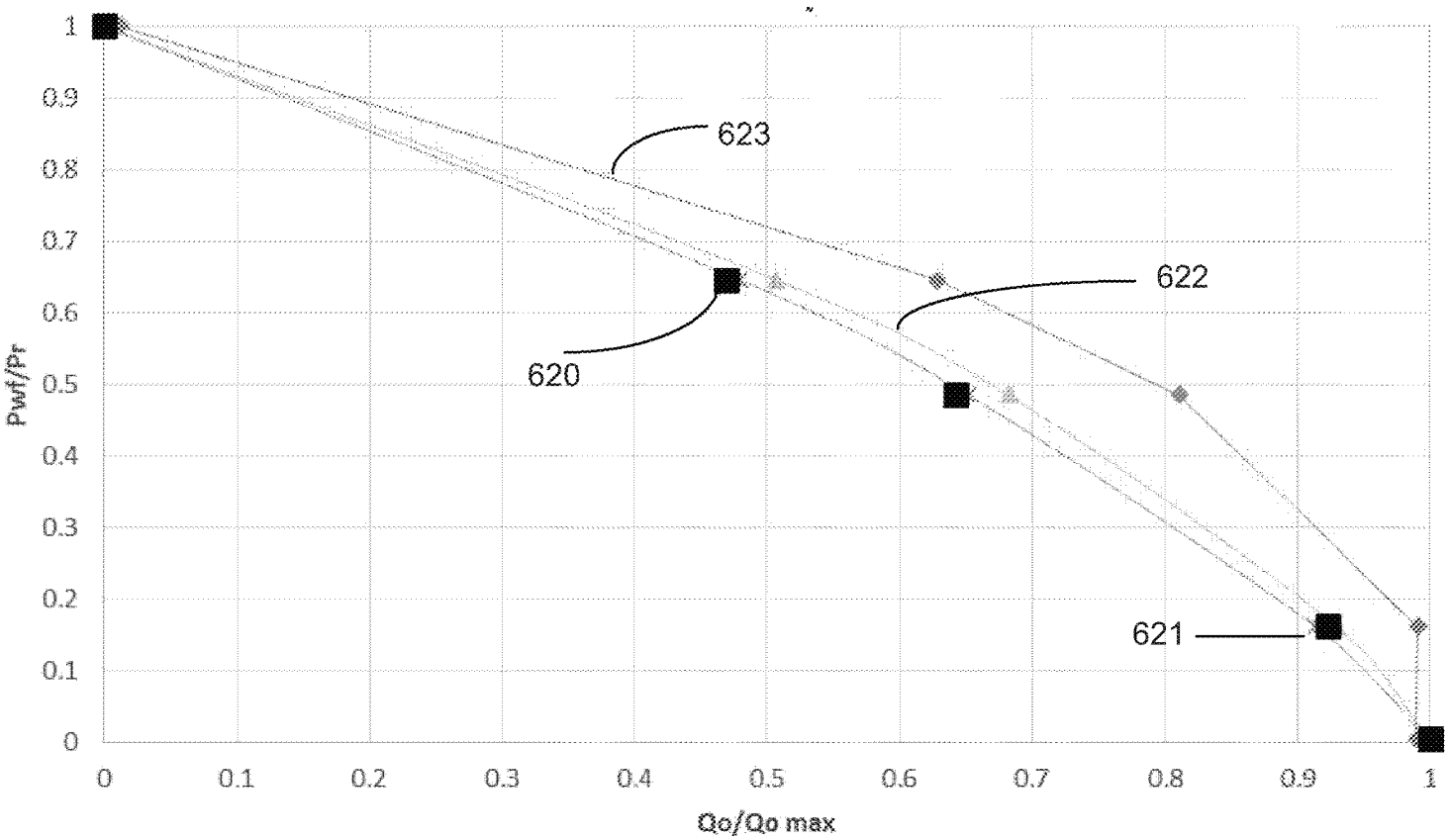

FIG. 6E depicts graphs illustrating the sum squared error (SSE) of a plurality of parameters for different values of γ (constant in the Box-Cox method). From FIG. 6E, it can be observed that each parameter exhibits lowest SSE value approximate to 1, thereby indicating that the linear function form for each parameter produces close results to the generated data behavior. Therefore, as described previously, linear weighting of each parameter can be performed to find the final form of $f_1$. FIG. 6F depicts a graph illustrating a comparison of the snaky well empirical correlation to Cheng's and Wiggin's horizontal well correlation. In FIG. 6F, the curve 623 corresponds to the performance of the Cheng's horizontal well model and curve 621 corresponds to Wiggin's model. Curve 620 corresponds to the data generated by the simulator for the snaky well and the curve 622 corresponds to the data obtained via the snaky well's empirical correlation. According to an embodiment, the data generated is represented below in Table III. From FIG. 6F, it can be observed that horizontal well correlations either under-predict or over-predict the performance of snaky horizontal wells.

TABLE III

| Simulator Generated data for snaky well. | | | | | |
|---|---|---|---|---|---|
| kx | 50 | mD | porosity | 0.2 | |
| ky | 40 | mD | h | 300 | ft |
| kz | 10 | mD | GOR | 616 | scf/stb |
| L | 907 | ft | BUR | 75 | deg/100 ft |
| rw | 0.33 | ft | A | 65 | ft |

Figure 6G:
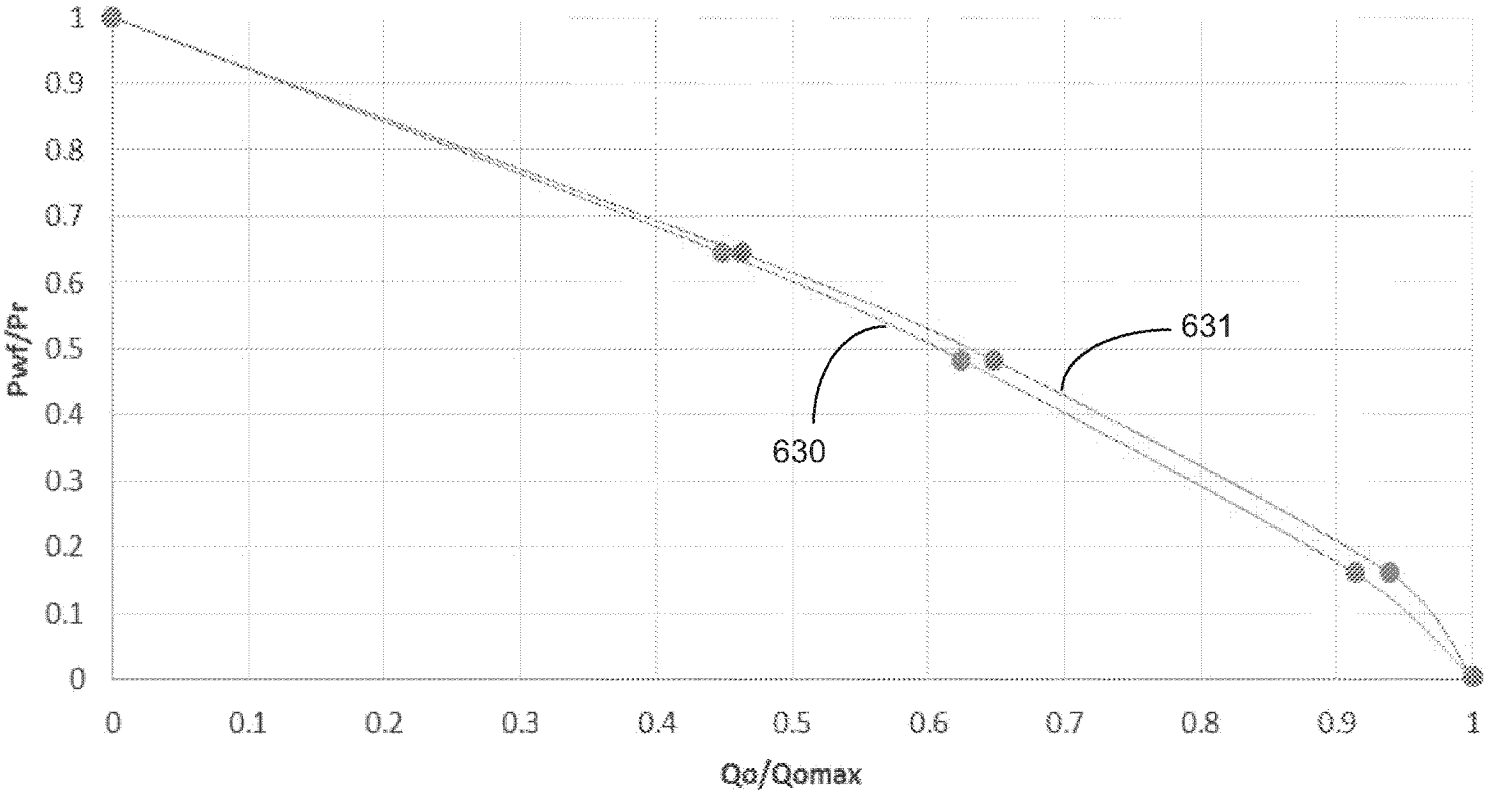

FIG. 6G depicts a graph illustrating the impact of the ratio of undulation amplitude on the performance of the snaky well. As described previously, ratio of undulation amplitude (λ) is a ratio of the height of undulation of the snaky well (A) to the horizontal length (L) of the snaky well, i.e., λ=A/L. According to an embodiment, a same ratio of undulation amplitude results in different well productivities for different values of the parameters A and L. For instance, as shown in FIG. 6G, the curves 630 and 631 have the same ratio of undulation with different values for the parameters A and L respectively. Therefore these parameters are specifically separated.

According to one embodiment, the parameters vertical permeability (kv) and horizontal permeability (square root of sum of kx and ky square) also affect the performance of the snaky well. For instance, as the ratio of vertical to horizontal permeability increases, the productivity of the snaky horizontal well increases due to a reduction of the amount of reservoir energy required for fluid flow. Furthermore, as the ratio kx/ky increases, the productivity of the snaky horizontal well decreases.

According to one embodiment, the effect of the well parameters on the performance of the snaky horizontal well can be modeled with a high degree of polynomial form instead of the quadratic form. It must be appreciated that a higher degree of polynomial produces a better R-square, wherein R-square is a statistical measure of how close the data is to the fitted regression line.

Each of the functions of the described embodiments may be implemented by one or more processing circuits. A processing circuit includes a programmed processor (for example, processor 703 in FIG. 7), as a processor includes circuitry. A processing circuit also includes devices such as an application-specific integrated circuit (ASIC) and conventional circuit components arranged to perform the recited functions.

Figure 7:
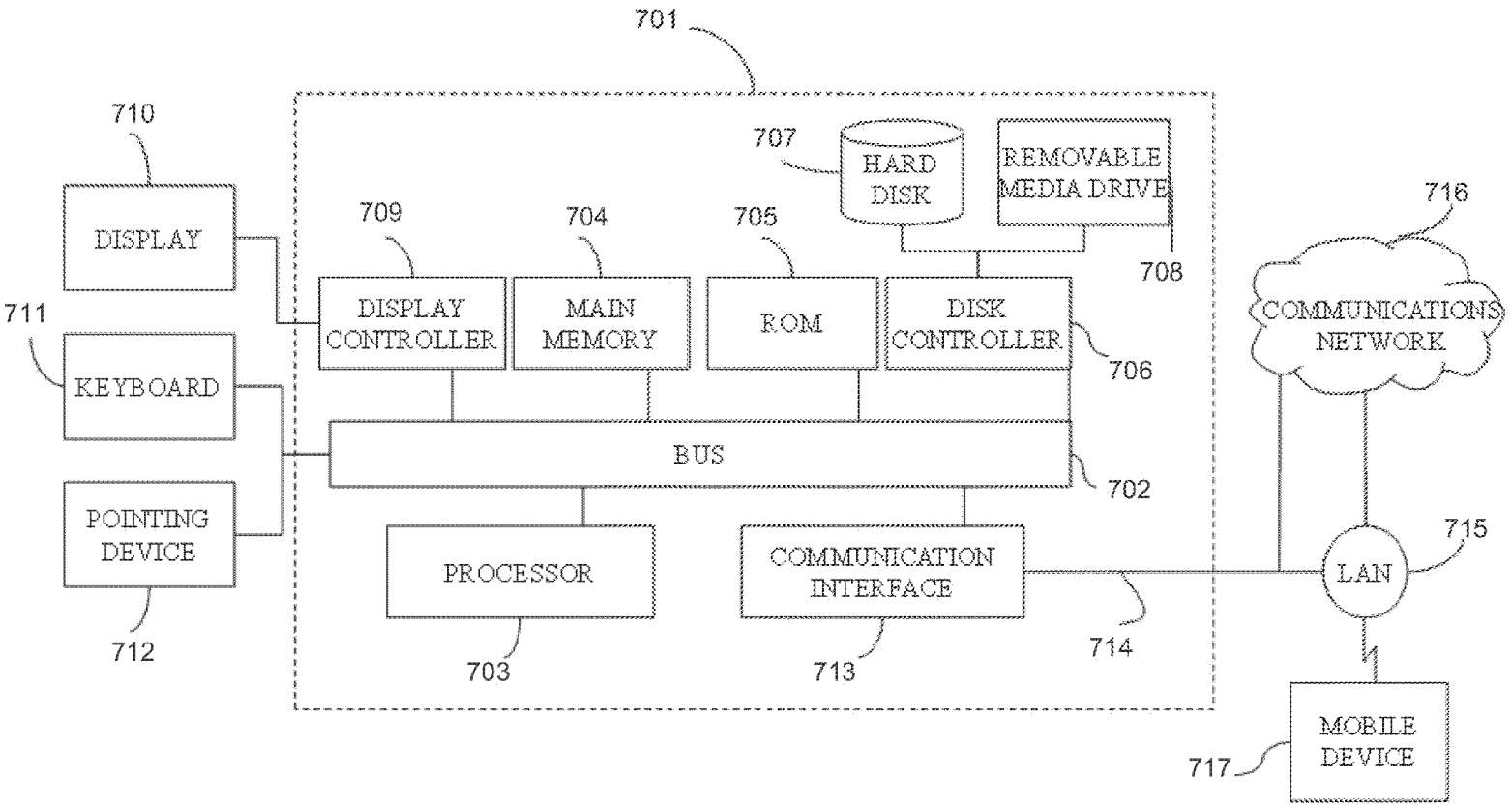
FIG. 7 illustrates a block diagram of a computing device according to an embodiment.

The various features discussed above may be implemented by a computer system (or programmable logic). FIG. 7 illustrates such a computer system 701. According to one embodiment, the computer system may be operated to determine an empirical model that enables estimating the inflow performance relationship of fishbone wells. Furthermore, the empirical model is determined a function of the number of rib-holes (multilateral branches) of the fishbone well. In doing so, a more accurate estimation of multilateral fishbone wells is obtained as compared to typical models that are used to estimate the performance of wells. The computer system 701 includes a disk controller 706 coupled to the bus 702 to control one or more storage devices for storing information and instructions, such as a magnetic hard disk 707, and a removable media drive 708 (e.g., floppy disk drive, read-only compact disc drive, read/write compact disc drive, compact disc jukebox, tape drive, and removable magneto-optical drive). The storage devices may be added to the computer system 701 using an appropriate device interface (e.g., small computer system interface (SCSI), integrated device electronics (IDE), enhanced-IDE (E-IDE), direct memory access (DMA), or ultra-DMA).

The computer system 701 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 701 may also include a display controller 709 coupled to the bus 702 to control a display 710, for displaying information to a computer user. The computer system includes input devices, such as a keyboard 711 and a pointing device 712, for interacting with a computer user and providing information to the processor 703. The pointing device 712, for example, may be a mouse, a trackball, a finger for a touch screen sensor, or a pointing stick for communicating direction information and command selections to the processor 703 and for controlling cursor movement on the display 710.

The processor 703 executes one or more sequences of one or more instructions contained in a memory, such as the main memory 704. Such instructions may be read into the main memory 704 from another computer readable medium, such as a hard disk 707 or a removable media drive 708. One or more processors in a multi-processing arrangement may also be employed to execute the sequences of instructions contained in main memory 704. In alternative embodiments, hard-wired circuitry may be used in place of or in combination with software instructions. Thus, embodiments are not limited to any specific combination of hardware circuitry and software.

As stated above, the computer system 701 includes at least one computer readable medium or memory for holding instructions programmed according to any of the teachings of the present disclosure and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, punch cards, paper tape, or other physical medium with patterns of holes.

Stored on any one or on a combination of computer readable media, the present disclosure includes software for controlling the computer system 701, for driving a device or devices for implementing the invention, and for enabling the computer system 701 to interact with a human user. Such software may include, but is not limited to, device drivers, operating systems, and applications software. Such computer readable media further includes the computer program product of the present disclosure for performing all or a portion (if processing is distributed) of the processing performed in implementing any portion of the invention.

The computer code devices of the present embodiments may be any interpretable or executable code mechanism, including but not limited to scripts, interpretable programs, dynamic link libraries (DLLs), Java classes, and complete executable programs. Moreover, parts of the processing of the present embodiments may be distributed for better performance, reliability, and/or cost.

The term "computer readable medium" as used herein refers to any non-transitory medium that participates in providing instructions to the processor 703 for execution. A computer readable medium may take many forms, including but not limited to, non-volatile media or volatile media. Non-volatile media includes, for example, optical, magnetic disks, and magneto-optical disks, such as the hard disk 707 or the removable media drive 708. Volatile media includes dynamic memory, such as the main memory 704. Transmission media, on the contrary, includes coaxial cables, copper wire and fiber optics, including the wires that make up the bus 702. Transmission media also may also take the form of acoustic or light waves, such as those generated during radio wave and infrared data communications.

Various forms of computer readable media may be involved in carrying out one or more sequences of one or more instructions to processor 703 for execution. For example, the instructions may initially be carried on a magnetic disk of a remote computer. The remote computer can load the instructions for implementing all or a portion of the present disclosure remotely into a dynamic memory and send the instructions over a telephone line using a modem. A modem local to the computer system 701 may receive the data on the telephone line and place the data on the bus 702. The bus 702 carries the data to the main memory 704, from which the processor 703 retrieves and executes the instructions. The instructions received by the main memory 704 may optionally be stored on storage device 707 or 708 either before or after execution by processor 703.

The computer system 701 also includes a communication interface 713 coupled to the bus 702. The communication interface 713 provides a two-way data communication coupling to a network link 714 that is connected to, for example, a local area network (LAN) 715, or to another communications network 716 such as the Internet. For example, the communication interface 713 may be a network interface card to attach to any packet switched LAN. As another example, the communication interface 713 may be an integrated services digital network (ISDN) card. Wireless links may also be implemented. In any such implementation, the communication interface 713 sends and receives electrical, electromagnetic or optical signals that carry digital data streams representing various types of information.

The network link 714 typically provides data communication through one or more networks to other data devices. For example, the network link 714 may provide a connection to another computer through a local network 715 (e.g., a LAN) or through equipment operated by a service provider, which provides communication services through a communications network 716. The local network 714 and the communications network 716 use, for example, electrical, electromagnetic, or optical signals that carry digital data streams, and the associated physical layer (e.g., CAT 5 cable, coaxial cable, optical fiber, etc.). The signals through the various networks and the signals on the network link 714 and through the communication interface 713, which carry the digital data to and from the computer system 701 may be implemented in baseband signals, or carrier wave based signals.

The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The computer system 701 can transmit and receive data, including program code, through the network(s) 715 and 716, the network link 714 and the communication interface 713. Moreover, the network link 714 may provide a connection through a LAN 715 to a mobile device 717 such as a personal digital assistant (PDA) laptop computer, or cellular telephone.

While aspects of the present disclosure have been described in conjunction with the specific embodiments thereof that are proposed as examples, alternatives, modifications, and variations to the examples may be made. Furthermore, the above disclosure also encompasses the embodiments noted below.

According to one embodiment, the model is capable to understand the behavior of each specific parameters to the production of oil. Specifically, by adjusting/modifying the values of the parameters of the snaky well in order to see the specific impact of the parameter whether it increases the total (cumulative) production of the well and increases the production rate of the well or not. For instance, values of parameters such as reservoir permeability is increased after hydraulic fracturing work, the significance/effect can be represented by adjusting the range of permeability in order to achieve the maximum production from the snaky well. The parameters are varied in the model to identify a regime in which production amount and/or production rate is increased.

In one embodiment values obtained directly from a well are input into the model. Values may include, for example, well bottom-hole pressure, gas-to-oil ratio, liquid in-flow rate, gas in-flow rate, and the like. Based on such values, the model is capable on predicting the production performance of that snaky well. Production engineers and Reservoir engineers as the end-users can perform this calculation to forecast and manage their field/area productions. The model will help engineers to decide the optimum production of the snaky well with the operating surface facilities pressure or pipelines network pressure to ensure its flow assurance.

Accordingly, embodiments as set forth herein are intended to be illustrative and not limiting. There are changes that may be made without departing from the scope of the claims set forth below.

The invention claimed is:

1. A method for managing a multilateral physical snaky well using an inflow performance relationship (IPR) and hydraulic fracturing work, comprising:

acquiring an operating surface facilities pressure and one or more physical parameters from the multilateral physical snaky well including at least a well bottom-hole pressure, a gas-to-oil ratio, and a liquid in-flow rate;

determining a grid model from a plurality of grid models for the multilateral physical snaky well;

simulating a plurality of well geometries for the determined grid model, the plurality of well geometries including a horizontal well, and a plurality of snaky lateral wells having different numbers of undulations and multiple orientations;

performing sensitivity analysis to determine an impact of a plurality of snaky well parameters on the IPR of the multilateral physical snaky well;

performing regression analysis based on the sensitivity analysis to determine Vogel based quadratic coefficient that estimates the IPR of the multilateral physical snaky well;

computing by circuitry, a transformation of the plurality of snaky well parameters to provide transformed parameters and determining a sum of squared errors of the plurality of snaky well parameters;

computing by circuitry, the IPR based on a linear weighting of the transformed parameters;

predicting a performance of the multilateral physical snaky well based on the IPR and the one or more physical parameters;

identifying a permeability in which a production amount is increased based on the operating surface facilities pressure and the predicted performance; and adjusting a permeability of a plurality of laterals of the multilateral physical snaky well using hydraulic fracturing work on the multilateral physical snaky well to match the identified permeability.

2. The method of claim 1, wherein the determining step further comprises:

comparing for a predetermined well bottom-hole pressure, a response of each grid model to a response of a horizontal well.

3. The method of claim 1, wherein the plurality of grid models include a horizontal well with trajectory design, a horizontal well without trajectory design, a horizontal well with trajectory design and structured local grid refinement (LGR), a horizontal well with trajectory design and unstructured LGR.

4. The method of claim 1, wherein the empirical model that estimates the IPR of the multilateral physical snaky well is formulated as:

$$\frac{q}{q_{max}} = 1 - f_1\frac{P_{wf}}{P_r} - (1 - f_1)\left(\frac{P_{wf}}{P_r}\right)^2,$$

wherein, $P_r$ is average reservoir pressure, $P_{wf}$ is bottom-hole pressure, q is oil rate, $q_{max}$ is a maximum achievable oil rate, and $f_1$ is Vogel based quadratic coefficient.

5. The method of claim 1, wherein the transformation of the plurality of snaky well parameters is performed by Box-Cox transformation method.

6. The method of claim 4, wherein the correlation parameter is computed as:

$$f_1 = 0.0435\frac{kx}{ky} - 0.0946\frac{kv}{kh} + \frac{3.0455}{A} - 0.0001368L + \frac{232.074}{GOR},$$

wherein, A is a height of undulation of the reservoir, GOR is gas-to-oil ratio, L is a horizontal span of the snaky well, kv is a vertical permeability of the reservoir, kh is horizontal permeability along the reservoir, and kx, ky are permeabilities in the x and y directions respectively.

* * * * *